United States Patent [19]

Aigo

[11] 4,170,959

[45] Oct. 16, 1979

[54] APPARATUS FOR BUMP-PLATING SEMICONDUCTOR WAFERS

[76] Inventor: Seiichiro Aigo, 3-15-13, Negishi, Daito-ku, Tokyo, Japan

[21] Appl. No.: 893,480

[22] Filed: Apr. 4, 1978

[51] Int. Cl.[2] ..... B05C 5/02

[52] U.S. Cl. ..... 118/627; 118/64; 118/500

[58] Field of Search ..... 118/620, 627, 64, 49.1, 118/421, 500; 427/82

[56] References Cited

U.S. PATENT DOCUMENTS

| | | | |
|---|---|---|---|
| 4,008,683 | 2/1977 | Rose | 118/49.1 |
| 4,075,974 | 2/1978 | Plows et al. | 118/64 |

*Primary Examiner*—John D. Welsh

[57] ABSTRACT

An apparatus for applying a bump-plating on one surface of a semiconductor wafer, which comprises a plurality of cup-shaped plating basins and a plurality of holders, each of the holders being engageable with a relevant one of the basins to set a semiconductor wafer horizontally, in which the underside of the wafer is contacted with plating liquid vertically blown up, the respective plating basins having an annular protrusion provided on the inner peripheral surface thereof to thereby bias internally a portion of plating liquid blown up along the inner surface of the plating basin so as to contact uniformly the plating liquid to the underside of the wafer as well as to average electric field density applied on the wafer surface.

3 Claims, 6 Drawing Figures

APPARATUS FOR BUMP-PLATING SEMICONDUCTOR WAFERS

BACKGROUND OF THE INVENTION

This invention relates to an improvement of an apparatus for bump-plating semiconductor wafers in which plating liquid is blown up from down to up against the wafers set horizontally in the respective plating basins.

This type of bump-plating apparatus is advantageously used for applying a bump-plating with gold, silver or the like on one surface of a semiconductor wafer, and enables to omit surplus plating steps and materials relating thereto relative to the previous type of the apparatus in which semiconductor wafers to be plated are held with pins at several positions of the periphery of wafers to be dipped in a plating liquid, because it is not required to coat a coating such as photoresist, wax or the like on a wafer surface not to be plated. These matters are described in the previous U.S. Ser. No. 832,332 now U.S. Pat. No. 4,137,867. However, in this type of bump-plating apparatus, plating liquid blown up against the wafer's surface is contacted with the outer peripheral portion more than with the other portions of wafer, and electric field density applied on the outer peripheral portion becomes comparatively high, which result in a thicker plating layer on the outer peripheral portion than the other portions of wafer. While, as semiconductor wafers are processed into elements of extremely delicate electric members, such variety of thickness of plating layer should cause a variety in quality of electronic products. Thus, uniformity of thickness of plating layer has been much desired.

SUMMARY OF THE INVENTION

Therefore, the main object of the invention is to provide an apparatus for bump-plating semiconductor wafers in which plating liquid is blown up against the underside of a horizontally set semiconductor wafer, which enables to bump-plate the wafer surface with uniform thickness of the plating layer.

In attaining the desired object of the invention, a bump-plating apparatus according to the present invention includes a plurality of cup-shaped plating basins within a container and a plurality of holders relative to and above the basins, semiconductor wafers to be plated being set horizontally between the basins and the holders, the upside surface of the wafer being blown down with air or inert gas to prevent it from contacting with plating liquid, and the underside surface is bump-plated in a bump-plating system with plating liquid which is blown up against the wafer surface, and the respective plating basins have an annular protrusion provided on the inner peripheral surface thereof to thereby bias internally a portion of plating liquid blown up along the inner surface of the plating basin so as to contact uniformly the plating liquid to the underside of wafer and to average electronic field density applied on the wafer surface.

BRIEF DESCRIPTION OF THE DRAWING

In the detailed description of the preferred embodiments presented below, reference is made to the accompanying drawing in which.

DESCRIPTION OF THE PREFERRED EMBODIMENTS

Figure 1:
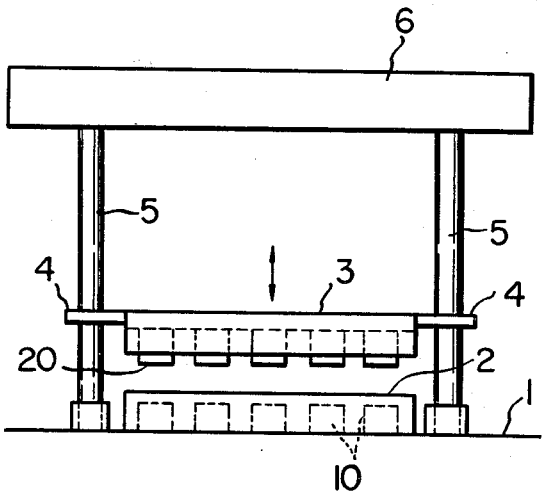
FIG. 1 is a side elevational view showing substantially the entirety of an apparatus for bump-plating semiconductor wafers embodied by the present invention.
Figure 2:
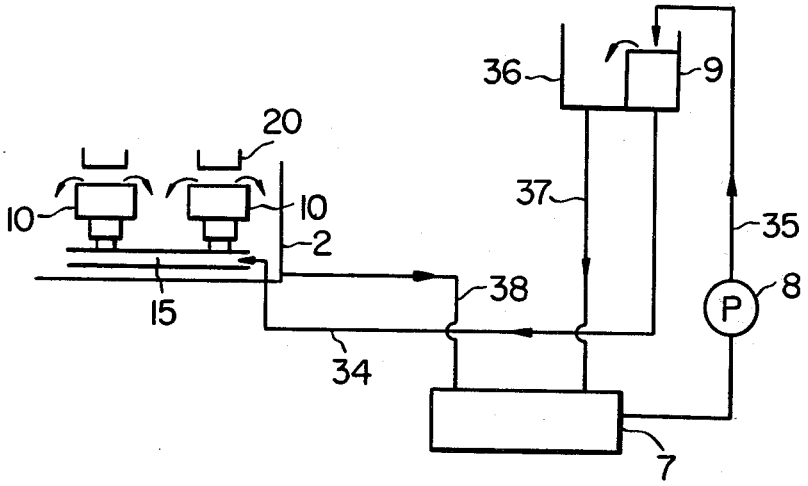
FIG. 2 is a schematic view of a plating system of the apparatus.

Referring now to FIG. 1, a bump-plating apparatus of the invention includes a container 2 secured on a base 1 and a cover 3 which is vertically movable above the container. This cover is guided vertically with opposite flanged portions 4 thereof, openings formed in the respective flanged portions being movably engaged with relevant guide bars 5. These guide bars are secured between the base 1 and a ceiling 6. The container includes therein a plurality of essentially cup-shaped plating basins 10 disposed on the same level, for example, 5 lines×5 rows=25 of the basins being included. Also, cover 3 has the same number of holders 20 secured thereto in position corresponding to the respective basins. As shown in FIG. 2, a system of this apparatus has a tank 7 for a plating liquid, a pump 8 and a sump 9 outside the container 2.

Figure 3:
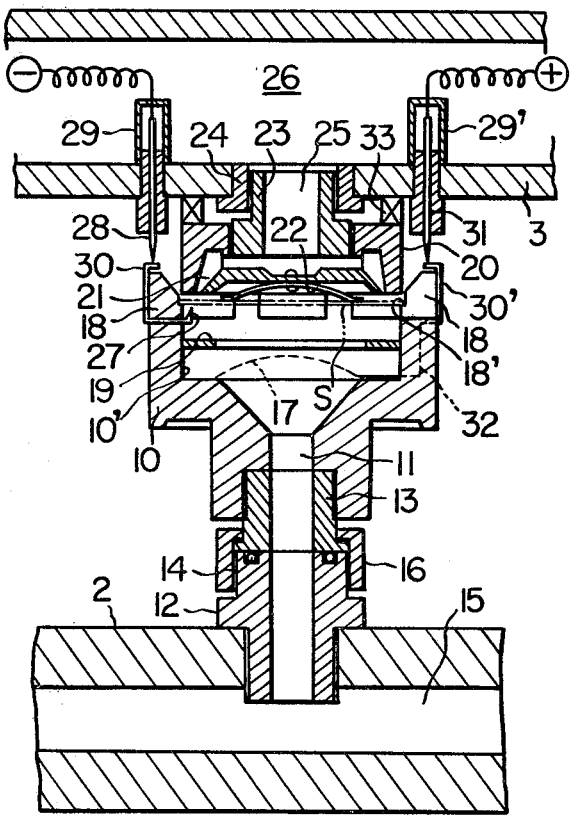
FIG. 3 is a vertical sectional view of a set of a plating basin and a relevant holder provided thereabove contained in the apparatus.

Plating basins 10 are preferably made of polypropylene, and as shown in FIG. 3, the axis of each basin 10 is vertical. Lower portion of the basin is of a tubular form provided with a central passage 11. The passage 11 is connected at the lowermost portion thereof with a common conduit 15 disposed in container 2 by means of adapter 12, sleeve 13 and O-ring 14 located therebetween. This passage 11 serves to blow up a plating liquid. 16 denotes a cap nut. A mesh-shaped anode 17 is provided on the flared top portion of passage 11 of the basin. The periphery of plating basin 10 is normally circular, and a plurality of equally spaced integral protrusions 18 are formed on the peripheral top of the basin. Each protrusion 18 is formed with a step 18' on its inner surface at the same level in order to set horizontally a semiconductor wafer to be plated. The inner surface of the respective protrusions 18 is preferably slant divergently upwards as shown in FIG. 3, to thereby facilitate the setting of semiconductor wafers. The periphery of each holder 20 is circular similarly to the basin 10. The bottom of holder 20 is formed with a nozzle 21 to prevent the upside surface of wafer from contacting with plating liquid by blowing out a gas through the nozzle. And, if desired, a ring-shaped resilient member will be secured to the lowermost outer periphery of holder 20. Also, the bottom surface of holder 20 is provided with a spring, preferably a curved leaf spring 22, to thereby hold resiliently and securely a semiconductor wafer S with a downward resilient force as well as to prevent the wafer from being adhered to the bottom of holder 20, when removed. Respective holders 20 are fixed to fitting portions 24 of the cover 3 with bushings 23 and have gas passage 25 formed axially thereof communicated with the nozzle 21. The top of passage 25 is connected to a common gas passage 26 provided in the cover 3.

Figure 4:
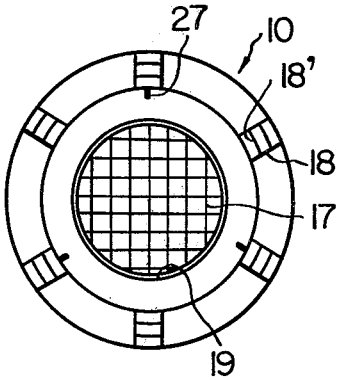
FIG. 4 is a plan view of a plating basin.
Figure 5:
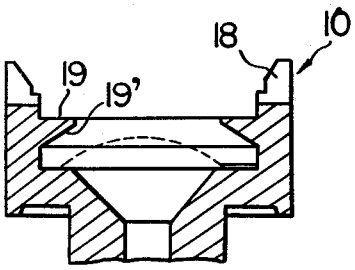
FIGS. 5 and 6 are respectively a vertical sectional view of a plating basin showing essential portions of other embodiments.
Figure 6:
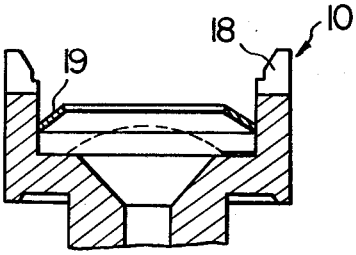

The bump-plating apparatus of the invention is characterized by an annular protrusion 19 extending circularly along the entire periphery of the inner peripheral surface of each plating basin 10, as shown in FIGS. 3 and 4. This protrusion 19 is preferably formed integrally with the body of plating basin 10, but may be adhered thereto by any suitable means. As a preferable form of the protrusion, the underside 19' thereof is slant so as to form an upwardly convergent annular form, as shown in FIGS. 5 and 6, to thereby bias a portion of plating liquid internally with a reduced flow resistance. Further, as shown in FIG. 6, the protrusion 19 may be of an upwardly convergent annular plate-type member. If desired, the internal diameter of the protrusion 19 will be adjustable such as an iris diaphragm.

Also, in the drawing, 27 denotes cathode-contact tips, 28 cathode electrode bar, 29 support member for the cathode electrode bar, 30 lead piece, and 31 anode electrode bar. The anode electrode bar is supported by a support member 29' and connected to the mesh-shaped anode 17 through a lead piece 30' and a lead wire 32. 33 denotes a cushion fixed between a holder 30 and cover 3.

As shown in FIG. 2, sump 9 is located in a higher level than container 2 and connected to common conduit 15 within the container through pipe line 34. Tank 7 and sump 9 are interconnected by pipe line 35 in which pump 8 is disposed. Sump 9 has a conduit portion 36 which is connected to tank 7 through pipe line 37. The bottom of container 2 is communicated with tank 7 through pipe line 38.

In operation, plating liquid in the tank 7 is introduced into sump 9 by means of pump 8. A portion of plating liquid in sump 9 overflows into conduit portion 36 and then returns to tank 7 through pipe line 37. The remaining plating liquid in sump 9 is inserted into common conduit 15 through pipe line 34 and into the respective plating basins through the respective central passages 11 and mesh-shaped anodes 17. Then the plating liquid is blown up against the underside surface of a set semiconductor wafer S, thereafter flowing out through spaces defined between protrusions 18 on the top periphery of plating basins 10, and falls down into container 2 from which the plating liquid returns to tank 7 through pipe line 38. In this process, plating liquid is blown up from down to up under a substantially constant pressure in each plating basin and after passing through mesh-shaped anode 17, a portion of plating liquid blown up along the inner peripheral surface 10' of the plating basin is biased internally by the annular protrusion 19. In addition thereto, the protrusion 19 serves to bias internally outer electric field between mesh-shaped anode 17 and a set wafer S. In this system, although it comprises a sump 9, the sump may not be employed. Then, discharge side of pump 8 will be directly connected to common conduit 15, if desired.

Therefore, according to the present invention, since a portion of plating liquid blown up against a set semiconductor wafer is biased internally by the annular protrusion 19 in each plating basin, plating liquid is contacted uniformly to the entire underside surface of the wafer. Also, electric field density applied on the entire wafer surface is averaged by the protrusion 19. Thus the bump-plated wafer has a uniform thickness of plated layer on the entire surface. While the prior art plating apparatus of this type, as previously described, has resulted in a thicker plating layer on outer peripheral portion than other portions of wafer surface, such variety of thickness of plating layer is considerably reduced by the arrangement of the invention. For example, as an example of the bump-plating of semiconductor wafer, a plating layer obtained by a prior art apparatus had a thicker layer on outer peripheral portion than that on the central portion by approximately 16% thereof, while such value of variety according to the apparatus of the invention could be reduced to less than 5%.

The present invention may be embodied in other forms or carried out in other ways without departing from the spirit or essential characteristics thereof. The present embodiments are therefore to be considered as in all respects illustrative and not respective, the scope of the invention being indicated by the appended claims, and all changes which come within the meaning and range of equivalency are intended to be embraced therein.

I claim:

1. An apparatus for bump-plating semiconductor wafers to bump-plate one surface thereof, comprising a plurality of cup-shaped plating basins secured within a container, the respective plating basins including cathode contact tips and a mesh-shaped anode, a plurality of holders secured in a cover which is movable relative to and above said container, each of said holders being aligned and engageable with a relevant one of said plating basins, semiconductor wafers to be plated being adapted to be set horizontally between said plating basins and said holders, the respective plating basins having an axial passage in the center of the bottom thereof communicated with a common conduit disposed in said container for blowing up therethrough plating liquid against the semiconductor wafers, said apparatus being characterized in that the respective plating basins have an annular protrusion provided on the inner peripheral surface thereof to thereby bias internally a portion of plating liquid blown up along the inner peripheral surface of the plating basin so as to contact uniformly plating liquid to the underside of wafer and to average electric field density applied on the wafer surface.

2. An apparatus for bump-plating semiconductor wafers set forth in claim 1, wherein underside surface of said protrusion is slant so as to form an upwardly convergent annular surface.

3. An apparatus for bump-plating semiconductor wafers set forth in claim 1, wherein said protrusion is of an upwardly convergent annular plate-type member.

* * * * *